US005752300A

United States Patent [19]

Dischler

[11] Patent Number: 5,752,300

[45] Date of Patent: May 19, 1998

[54] METHOD AND APPARATUS TO LOOSEN AND CUT THE WRAPPER FIBERS OF SPUN YARNS IN WOVEN FABRIC

[75] Inventor: Louis Dischler, Spartanburg, S.C.

[73] Assignee: Milliken Research Corporation, Spartanburg, S.C.

[21] Appl. No.: 738,787

[22] Filed: Oct. 29, 1996

[51] Int. Cl.[6] ..... D06C 11/00

[52] U.S. Cl. ..... 26/28; 26/7; 28/170

[58] Field of Search ..... 26/27, 28, 29 R, 26/29 P, 7, 10.4, 11; 451/178, 182, 188, 189, 242, 244, 246, 28, 11, 12, 21; 51/309; 28/162, 163, 165, 170

[56] References Cited

U.S. PATENT DOCUMENTS

| | | | |
|---|---|---|---|
| 2,253,559 | 8/1941 | Curtin | 26/28 |
| 2,922,214 | 1/1960 | Gilbreath, Jr. | 26/28 |
| 3,523,346 | 8/1970 | Bolen et al. | 26/28 |
| 4,480,362 | 11/1984 | Maxwell | 26/28 |
| 4,505,720 | 3/1985 | Gabor et al. | 51/309 |
| 4,918,795 | 4/1990 | Dischler | 26/18.5 |
| 4,947,528 | 8/1990 | Dischler | 26/2 R |
| 5,058,329 | 10/1991 | Love et al. | 51/323 |
| 5,109,630 | 5/1992 | Love et al. | 51/74 R |
| 5,205,140 | 4/1993 | Nielsen et al. | 66/147 |
| 5,216,747 | 6/1993 | Riedel | 26/68 |
| 5,392,499 | 2/1995 | Bertoldo | 26/28 |
| 5,459,911 | 10/1995 | Iwami | 26/28 |

*Primary Examiner*—Amy B. Vanatta
*Attorney, Agent, or Firm*—Terry T. Moyer; George M. Fisher

[57] ABSTRACT

A method and apparatus for loosening, cutting, and abrading a web of textile fabric having spun yarns containing wrapper fibers. The textile fabric web is directed under high tension around a rotatable, small diameter tube coated with abrasive particles. Abrasive particles are preferably rounded (nonfaceted) tungsten carbide particles. The tube can be rotated at a slow speed and the surface speed of the tube may be a fixed percentage of the textile fabric web speed. The contact angle of the textile fabric web with the tube is between one (1) and one hundred and twenty (120) degrees. The average pressure between the textile fabric web and the tube should exceed two (2) pounds per square inch (p.s.i.).

61 Claims, 5 Drawing Sheets

METHOD AND APPARATUS TO LOOSEN AND CUT THE WRAPPER FIBERS OF SPUN YARNS IN WOVEN FABRIC

BACKGROUND OF THE INVENTION

There are several types of spun yarns commonly used in the construction of woven fabrics. Among the most common, and familiar to those versed in the art, are ring spun, open-end spun (OES), air-jet spun (AJS), and roller jet spun (RJS) yarns. Ring spun yarns consist of generally helically wound fibers which, when woven into fabrics, exhibit excellent hand and strength characteristics. It is known that, as the twist level is increased for ring spun yarns, the fabric containing them becomes stiffer and harsher, as increased twist reduces fiber-to-fiber mobility. OE yarns, compared to ring spun yarns, are more disorganized and have a lower twist. The fiber bundle comprising the yarn is compacted by the presence of tightly wound wrapper fibers, which are nearly perpendicular to the axis of the yarn. As the yarn structure of OE yarns is less organized than that of ring spun yarns, the OE yarn exhibits a larger diameter than that of a ring spun of an equivalent denier. The larger size of the OE yarn, coupled with the lack of mobility of the fibers, because of the pressure imparted by the wrapper fibers, results in a stiffer fabric, in spite of the lower twist as compared to ring spun yarns. The tightly wound wrapper fibers also cause the surface of the fabric to be harsh and scratchy to the touch. The relative fiber immobility makes it difficult to enhance the fabric by needling with hydraulic jets, as these yarns cannot easily blossom when constricted by the wrapper fibers. In the same way, wrapper fibers reduce the effectiveness of pneumatic vibratory softening as disclosed in U.S. Pat. No. 4,918,795, issued Apr. 24, 1990. As the wrapper fibers are not aligned with the axis of the yarn, they do not contribute to fabric strength, and fabrics constructed of yarns containing wrapper fibers are generally not as strong as fabrics constructed of ring spun yarns. AJS and RJS yarns are similar to OE yarns, but have core fibers with little or no twist, and the integrity of the yarn entirely depends upon the presence of the wrapper fibers. Without the fiber-to-fiber friction created by the pressure exerted by the wrapper fibers, the yarn would have no tenacity and could not be woven into fabrics. Once a fabric has been woven, yarn-to-yarn pressures are sufficient to create frictional forces between fibers, and the wrapper fibers are no longer necessary for strength. Loosening or cutting wrapper fibers, so as to improve the hand and other properties, without substantial cutting of the load bearing fibers, can dramatically improve the hand and surface touch of the fabric, allow the fabric to blossom when hydraulically needled or to soften when pneumatically vibrated, as well as abrading the fabric to improve adhesion to coatings, without degrading fabric strength. Other methods of sanding and abrading textile fabrics are known, such as that disclosed in U.S. Pat. No. 5,058,329, issued Oct. 22, 1991, however they are not effective in severing or sufficiently loosening the wrapper fibers within the fabric in order to create significant associated benefits resulting therefrom without also cutting load bearing fibers and substantially weakening the strength of the fabric.

The present invention solves these problems in a manner not disclosed in the known prior art.

SUMMARY OF THE INVENTION

A method and apparatus for loosening, cutting, and abrading a web of textile fabric having spun yarns containing wrapper fibers. The textile fabric web is directed under high tension around a rotatable, small diameter tube coated with abrasive particles. Abrasive particles are preferably rounded (nonfaceted) tungsten carbide particles. The tube can be rotated at a slow speed and the surface speed of the tube may be a fixed percentage of the textile fabric web speed. The contact angle of the textile fabric web with the tube is between one (1) and one hundred and twenty (120) degrees. The average pressure between the textile fabric web and the tube should exceed two (2) pounds per square inch (p.s.i.).

It is an advantage of this invention to provide greater adhesion between a textile fabric web and an applied chemical coating.

It is another advantage of this invention to be able to fully allow the individual yarns, having wrapper fibers, to blossom when subjected to hydro-enhancement treatment.

Another advantage of this invention is to reduce the compressive pressure exerted by the wrapper fibers to allow the fabric to be softened by pneumatic vibratory means.

Yet another advantage of this invention is to improve the hand of a textile fabric web.

Still another advantage of this invention is that it provides a very uniform treatment with good strength retention and minimal shade change for dyed fabric.

Another advantage of this invention is that the process is is relatively insensitive to the speed of the textile fabric web.

These and other advantages will be in part apparent and in part pointed out below.

BRIEF DESCRIPTION OF THE DRAWINGS

The above as well as other objects of the invention will become more apparent from the following detailed description of the preferred embodiment of the invention, which when taken together with the accompanying drawings in which.

Corresponding reference characters indicate corresponding parts throughout the several views of the drawings.

DETAILED DESCRIPTION OF THE PREFERRED EMBODIMENT

This invention is directed to a method and apparatus for loosening and cutting wrapper fibers of a textile fabric web. The textile fabric can of virtually any construction such as woven, nonwoven, knitted, and so forth, and can comprise yarns of synthetic filament fibers or spun yarns of natural or synthetic staple fibers or blends thereof.

Figure 1:
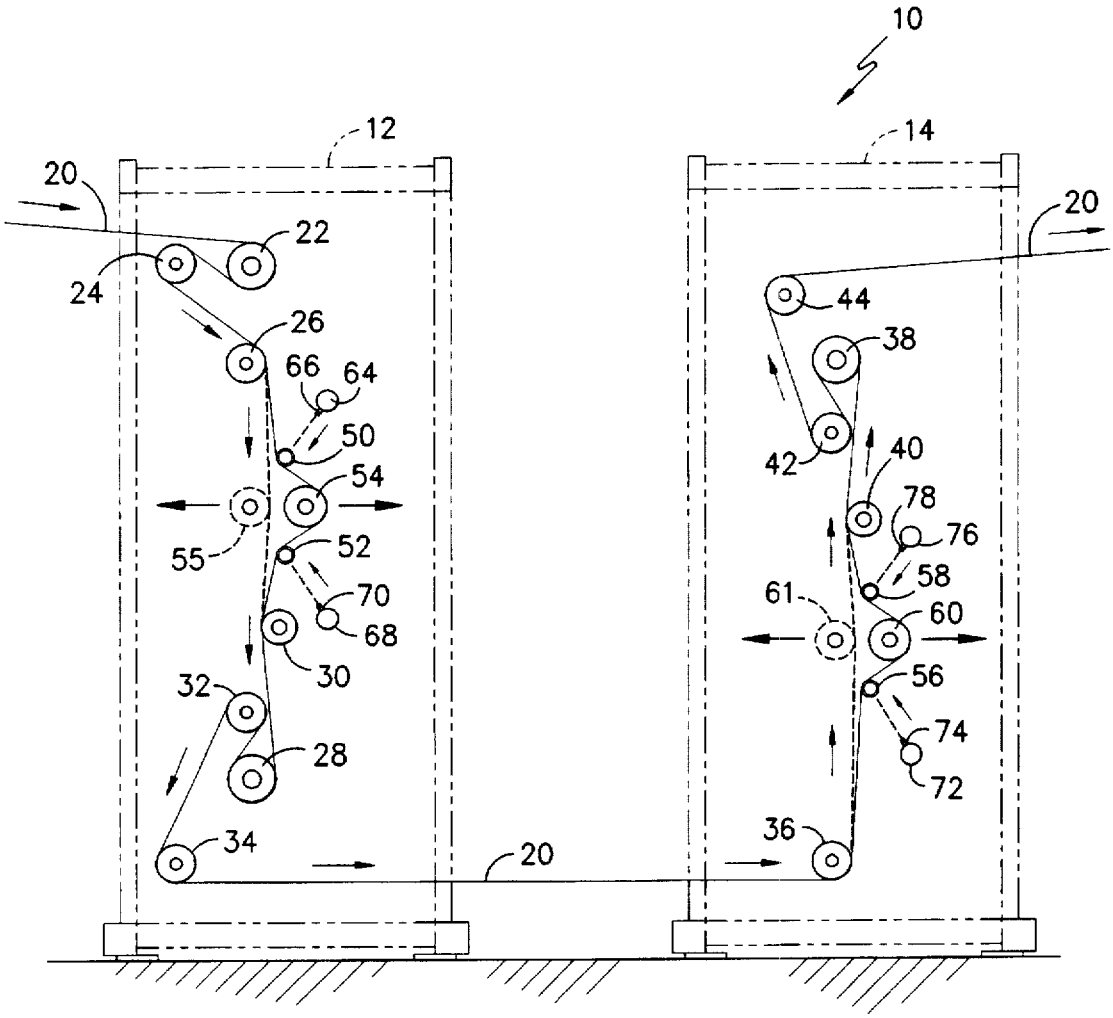
FIG. 1 is a schematized side view of the apparatus for loosening and cutting wrapper fibers of the instant invention wherein a textile fabric web, having a top portion and a bottom portion, is treated on both the top portion and the bottom portion.

Referring now to the accompanying drawings, and initially to FIG. 1, an apparatus for loosening and cutting wrapper fibers of spun yarns is generally indicated by numeral 10, which includes both a first frame 12 and a second frame 14. The moving textile fabric web 20 initially travels around a first drive roll 22 that is rotating at a surface speed of between ten (10) to four hundred (400) yards per minute (y.p.m.). However, a preferred range of speeds for the first drive roll 22 is between fifty (50) and three hundred (300) yards per minute (y.p.m.) and an optimal range is between seventy-five (75) and two hundred (200) yards per minute (y.p.m.). The textile fabric web 20 then passes over a first idler roll 24 and a second idler roll 26. The top portion of the textile fabric web 20 then passes underneath a first treatment tube 50 and then the back portion of the textile fabric web 20 goes over a first engagement roll 54 and then the top portion of the textile fabric web 20 passes underneath a second treatment tube 52. Due to the position of the first engagement roll 54, the angle at which either the first treatment tube 50 or the second treatment tube 52 strikes the textile fabric web 20 can range between zero (0) and one hundred and twenty (120) degrees as a practical maximum even though ninety degrees is the maximum for the apparatus shown in FIGS. 1–9. The preferred range is between ten (10) and ninety (90) degrees and the optimal range is between thirty (30) and eighty (80) degrees. The first engagement roll 54 can move to a disengagement position 55 as shown in FIG. 1. This will allow the textile fabric web 20 to completely bypass both the first treatment tube 50 and the second treatment tube 52.

There is a first air tube 64 having a first series of air jets 66 that direct pressurized air against the first treatment tube 50 in order to dispel fiber particles and lint. Likewise, adjacent to second treatment tube 52 is a second air tube 68 having a second series of air jets 70 for dispelling fiber and lint from the textile fabric web 20 generated by the second treatment tube 52. Air exits the first and second series of air jets 66 and 70, respectively at a range of five (5) to two hundred and fifty (250) pounds per square inch (p.s.i.). However the preferred range is between twenty (20) to one hundred fifty (150) pounds per square inch (p.s.i.) and the optimal range is between forty (40) to one hundred (100) pounds per square inch (p.s.i.).

Figure 7:
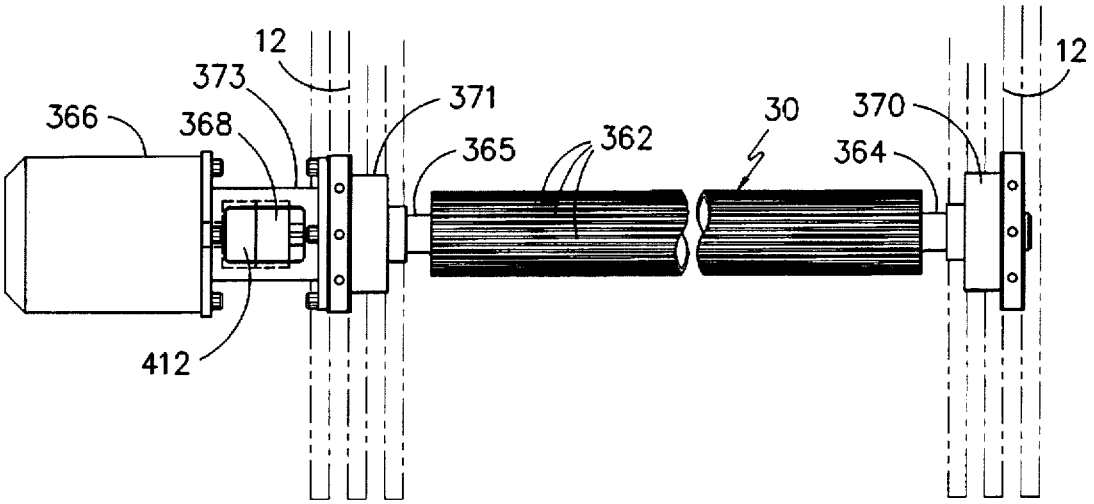
FIG. 7 is an elevational view of a debris/lint removal roll with associated bearings, coupling, and drive motor.
Figure 8:
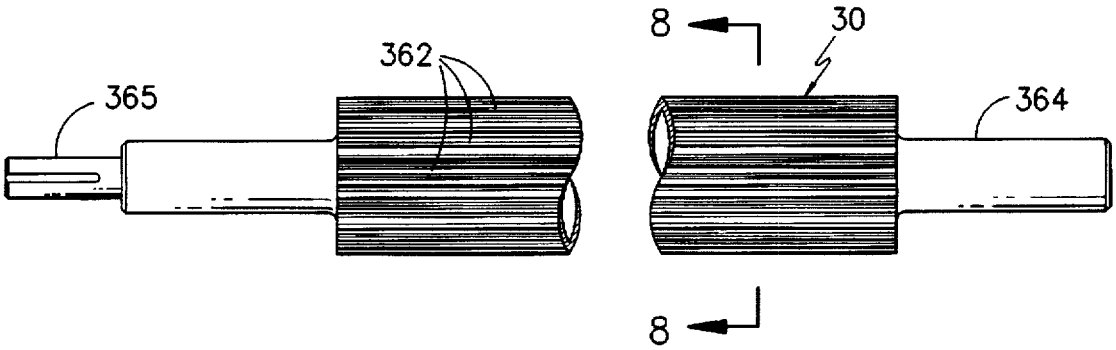
FIG. 8 is an isolated view of the debris/lint removal roll shown in FIG. 7.
Figure 9:
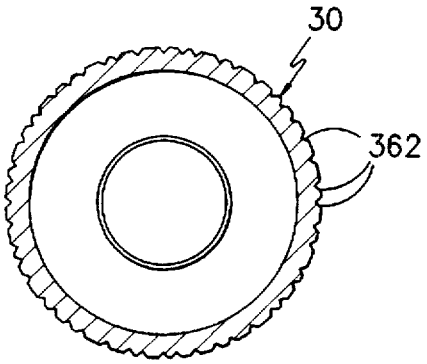
FIG. 9 is a cross-sectional view of the debris/lint removal roll taken along Line 8—8 of FIG. 8.

The textile fabric web 20 then passes over a first lint/debris removal roll 30, as shown in FIGS. 7, 8, and 9. This debris/lint removal roll 30 rotates at a relatively high speed in the range of between five hundred (500) to three thousand (3,000) revolutions per minute (r.p.m.). However, a preferred range of speeds for the first lint/debris removal roll 30 is between eight hundred (800) and two thousand and five hundred (2,500) revolutions per minute (r.p.m.) and an optimal range is between one thousand (1,000) and two thousand (2,000) revolutions per minute (r.p.m.). As shown in FIG. 9, there is a series of grooves 362 along the longitudinal axis of the first lint/debris removal roll 30 that can vary in width in a range of 0.01 to 2 inches. However, the preferred range of widths for the groves 362 of the first lint/debris removal roll 30 is between 0.02 to 1 inches and the optimal range of widths for the groves 362 is between 0.05 to 0.5 inches. The grooves 362 can be cut in a variety of angles that can vary in a range of five (5) to one hundred eighty (180) degrees. However, the preferred range of angles for the groves 362 of the first lint/debris removal roll 30 is between fifteen (15) to one hundred eighty (180) degrees and the optimal range of angles for the groves 362 is between forty-five (45) to one hundred eighty (180) degrees. The distance between grooves 362 can vary in a range of 0.05 to 2 inches. However, the preferred distance between groves 362 of the first lint/debris removal roll 30 is between 0.1 to 1 inches and the optimal range of distance between groves 362 is between 0.1 to 0.5 inches. While the grooves may be spaced around the roll with a uniform spacing, it is preferred that the spacing be varied in a random way in order to distribute the noise produced by the action of this roll on the fabric over a range of frequencies. The depth of the grooves 362 can vary in a range of 0.01 to 0.5 inches. However, the preferred depth of the grooves 362 of the first lint/debris removal roll 30 is between 0.01 to 0.25 inches and the optimal range of depth of the grooves 362 is between 0.01 to 0.1 inches. The range of diameters for the first lint/debris removal roll 30 is between three (3) to sixteen (16) inches. The preferred range of diameters for the first lint/debris removal roll 30 is between 3.5 to twelve (12) inches and the optimal range of diameters is between four (4) to ten (10) inches.

As shown in FIGS. 7 and 8, the first lint/debris removal roll 30 has a first axle 364 located on the first end portion of the lint/debris removal roll 30 that is rotatably attached to the first frame 12 by means of a first bearing 370 and a second axle 365 located on the second end portion of the lint/debris removal roll 30 that is rotatably attached to the first frame 12 by means of a second bearing 371. The second axle 365 is rotated by means of a drive motor 366 that is attached thereto by means of a coupling mechanism 368. There is also a bracket 373 for supporting and attaching the drive motor 366 and the coupling mechanism 368 to the first frame 12. This bracket 373 has a coupling 412 located within the bracket 373.

Referring again to FIG. 1, the textile fabric web 20 then passes over a second drive roll 28 that is also rotating at a surface speed of between ten (10) to four hundred (400) yards per minute (y.p.m.). However, a preferred range of speeds for the second drive roll 28 is between sixty (60) and three hundred (300) yards per minute (y.p.m.) and the optimal range is between seventy-five (75) and two hundred (200) yards per minute (y.p.m.). The textile fabric web 20 then passes over a fourth idler roll 32 and a fifth idler roll 34 and then travels to the second frame 14.

Upon entering the second frame 14, the textile fabric web 20 passes around a sixth idler roll 36 that directs the textile fabric web 20 into a third treatment tube 56. The bottom portion of the textile fabric web 20 then passes over a third treatment tube 56 and then the top portion of the textile fabric web 20 goes over a second engagement roll 60 and then the bottom portion of the textile fabric web 20 passes over a fourth treatment tube 58. Due to the position of the second engagement roll 60, the angle at which either the third treatment tube 56 or the fourth treatment tube 58 strikes the textile fabric web 20 can range between zero (0) and one hundred and twenty (120) degrees as a practical maximum even though ninety degrees is the maximum for the apparatus shown in FIGS. 1–9. The preferred range is between ten (10) and ninety (90) degrees and the optimal range is between 30 and 80 degrees. The second engagement roll 60 can move to a disengagement position 61, as shown in FIG.

1. This will allow the textile fabric web 20 to completely bypass both the third treatment tube 56 and the fourth treatment tube 58.

There is a third air tube 72, having a third series of air jets 74, that direct pressurized air against the third treatment tube 56 in order to dispel fiber particles and lint. Likewise, adjacent to fourth treatment tube 58 is a fourth air tube 76 having a fourth series of air jets 78 for dispelling fiber and lint from the textile fabric web 20 generated by the fourth treatment tube 58. Air exits the third and fourth series of air jets 72 and 76, respectively at a range of five (5) to two hundred fifty (250) pounds per square inch (p.s.i.). However, the preferred range is between twenty (20) to one hundred fifty (150) pounds per square inch (p.s.i.) and the optimal range is between forty (40) to one hundred (100) pounds per square inch (p.s.i.).

The textile fabric web 20 then passes over a second lint/debris removal roll 40 that is substantially similar to the first lint/debris removal roll 30 that is shown in FIGS. 7, 8, and 9. This second lint/debris removal roll 40 rotates at a relatively high speed in the range of between five hundred (500) to three thousand (3,000) revolutions per minute (r.p.m.). However, a preferred range of speeds for the second lint/debris removal roll 40 is between eight hundred (800) and two thousand and five hundred (2,500) revolutions per minute (r.p.m.) and an optimal range is between 1,000 and 2,000 revolutions per minute (r.p.m.). As shown by analogy in FIG. 9, there are a series of grooves 362 along the longitudinal axis of the second lint/debris removal roll 40 that can vary in width in a range of 0.01 to two (2) inches. However, the preferred range of widths for the groves 362 of the second lint/debris removal roll 40 is between 0.02 to one (1) inches and the optimal range of widths for the groves 362 is between 0.05 to 0.5 inches. The grooves 362 can be cut in a variety of angles that can vary in a range of five (5) to one hundred (180) degrees. However, the preferred range of angles for the groves 362 of the second lint/debris removal roll 40 is between fifteen (15) to one hundred eighty (180) degrees and the optimal range of angles for the groves 362 is between forty-five (45) to one hundred eighty (180) degrees. The distance between grooves 362 can vary in a range of 0.05 to two (2) inches. However, the preferred distance between groves 362 of the second lint/debris removal roll 40 is between 0.1 to one (1) inches and the optimal range of distance between groves is between 0.1 to 0.5 inches. The depth of the grooves 362 can vary in a range of 0.01 to 0.5 inches. However, the preferred depth of the grooves 362 of the second lint/debris removal roll 40 is between 0.01 to 0.25 inches and the optimal range of depth of the grooves 362 is between 0.01 to 0.1 inches. The range of diameters for the second lint/debris removal roll 40 is between three (3) to sixteen (16) inches. The preferred range of diameters for the second lint/debris removal roll 40 is between 3.5 to twelve (12) inches and the optimal range of diameters is between four (4) to ten (10) inches.

Not shown, but by analogy to FIGS. 7 and 8, the second lint/debris removal roll 40 has a first axle 364 located on the first end portion of the second lint/debris removal roll 40 that is rotatably attached to the second frame 14 by means of a first bearing 370 and a second axle 365 located on the second end portion of the lint/debris removal roll 40 that is rotatably attached to the second frame 14 by means of a second bearing 371. The second axle 365 is rotated by means of a drive motor 366 that is attached thereto by means of a coupling mechanism 368. There is also a bracket 373 for supporting and attaching the drive motor 366 and the coupling mechanism 368 to the first frame 12.

Referring again to FIG. 1, the textile fabric web 20 is then engaged by a third drive roll 38 that is rotating at a surface speed of between ten (10) to four hundred (400) yards per minute (y.p.m.). However, a preferred range of speed for the third drive roll 38 is between sixty (60) and three hundred (300) yards per minute (y.p.m.) with the optimal range of speeds for the third drive roll 38 is between seventy-five (75) and two hundred (200) yards per minute (y.p.m.). The textile fabric web 20 then passes over an eighth idler roll 42 and a ninth idler roll 44 and exits the second frame 14. Treatment tubes 50, 52, 56, and 58 are substantially similar having a relatively small diameter in a range of between one (1) to four (4) inches. However, a preferred range of treatment tube diameter is between 1.5 to 3.5 inches with the optimal range of two (2) to three (3) inches. The first treatment tube 50, second treatment tube 52, third treatment tube 56, and fourth treatment tube 58 are primed by abrasive blasting and thermal spray coated with powder comprising tungsten carbide and nickel or cobalt as a binder. The binder portion of the powder melts during the operation and produces a tenacious inter-metallic bond between the primed steel tube and the tungsten carbide particles. As the powder particles are partially fused and re-solidified, the surface of the particles when observed microscopically is relatively rounded compared to the faceted character of typical abrasive grains. This lack of aggressiveness compared to typical abrasives provides a two-fold advantage. The first advantage is that there is no breaking-in period for the abrasive which occurs with faceted abrasives as the edges between facets wear during use. The second advantage is that this abrasive preferentially engages and cuts the wrapper fibers that are tightly wound around the core yarns while leaving the other fibers relatively intact. The cutting of the wrapper fibers does not substantially contribute to a reduction in the tensile strength or the tear properties for the textile fabric web 20. The width of the textile fabric web is typically about 64 inches. However, this is merely an illustrative example and can vary as desired. The tension on this textile fabric web 20 prior to treatment by the first treatment tube 50 can range between one hundred (100) to about one thousand (1,000) pounds of tension and is substantially increased within the apparatus 10. However, the preferred range can be between one hundred fifty (150) to eight hundred (800) pounds of tension with the optimal range between two hundred fifty (250) to eight hundred (800) pounds of tension. There is at least two (2) pounds per square inch (p.s.i.) of average pressure between the textile fabric web 20 and the treatment tubes 50, 52, 56 and 58.

Figure 2:
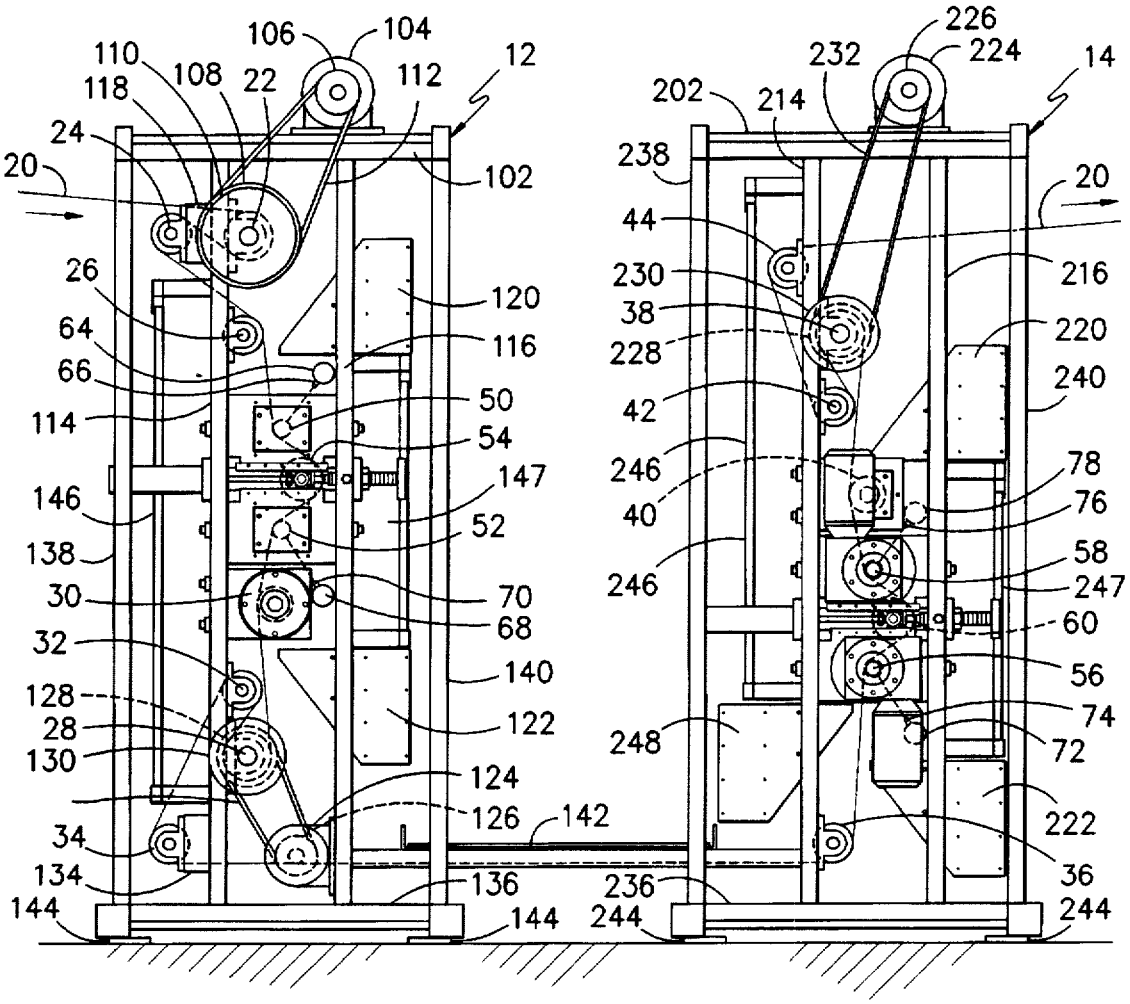
FIG. 2 is a side elevational view of the apparatus for loosening and cutting wrapper fibers of the instant invention wherein a textile fabric web, having a top portion and a bottom portion, is treated on both the top portion and the bottom portion.

Referring now to FIG. 2, as stated above, the textile fabric web 20 first comes in contact with the first drive roll 22. The first drive roll 22 is rotated by means of a first motor 104 having a first pulley 106 attached thereto. The first pulley 106 rotates a second pulley 108 by means of first belt 112 that encircles the first pulley 106 and the second pulley 108. This second pulley 108 is attached to the first drive roll 22 by means of a first planetary gearbox 110. The first motor 104 is attached to a top member 102 of the first frame 12. The first planetary gearbox 110 is rotatably attached to a first inner vertical member 114 of frame 12. An illustrative, but non-limiting, example of a first motor 104 would be a ten (10) horsepower, six hundred (600) volt drive motor manufactured by Baldor located at Fort Smith, Ark. An illustrative, but non-limiting, example of a planetary gearbox 110 would be one manufactured by Andantex located at Ocean Township, N.J. On the opposite side of the first inner vertical member 114 is a first load cell 118 that is connected to the first idler roll 24. An illustrated, but non-limiting example of a load cell is manufactured by Dover Flexo Electronics, Inc. located at Rochester, N.H. The load cell operates to provide uniformity to the amount of pressure between the textile fabric web 20 and the treatment tubes 50, 52, 56, and 58. The second idler roll 26 is attached to the same side of first inner vertical number 114 as first drive roll 22 and is located below the first drive roll 22. There is a second inner vertical number 116 having the first air tube 64 and the second air tube 68 attached thereto. Slightly above the first air tube 64 is a first vacuum manifold 120 and in a symmetrical manner, there is a second vacuum manifold 122 mounted slightly below the second air tube 68. After treatment by the first treatment tube 50 and over the first engagement roll 54 and then over the second treatment tube 52, the textile fabric web 20 passes over the lint/debris removal roll 30, as discussed above, and then around the second drive roll 28. The second drive roll 28 is rotated by means of a second motor 124 having a third pulley 126 attached thereto. The third pulley 126 rotates a fourth pulley 128 by means of second belt 132 that encircles the third pulley 126 and the fourth pulley 128. This fourth pulley 128 is attached to the second drive roll 28 by means of a second planetary gearbox 130. The second motor 124 is attached to the second inner vertical member 116 and located directly below the second vacuum manifold 122 and attached to the same side of the second inner vertical member 116 as the first air tube 64 and the second air tube 68. The second planetary gearbox 130 is rotatably attached to the first inner vertical number 114 of frame 12 on the same side and below the first planetary gearbox 110. An illustrated, but non-limiting, example of a second motor 124 would be a thirty (30) horsepower, six hundred (600) volt drive motor manufactured by Baldor located at Fort Smith, Ark. An illustrated, but non-limiting example of a second planetary gearbox 130 is manufactured by Andantex located at Ocean Township, N.J.

The textile fabric web 20 then passes over a fourth idler roll 32 that is attached above the same side of the first inner vertical member 114. The textile fabric web 20 then passes around a fifth idler roller 34 that is attached to the opposite side the first inner vertical number 114 by means of a second load cell 134.

After having the wrapper fibers of the textile fabric web 20 loosened and cut on the top of the textile fabric web 20, the textile fabric web 20 is then transported from the first frame 12 to the second frame 14 under a walkway 142 in order to treat the back of the textile fabric web. This walkway 142 allows operator access to the unit while in operation.

The first frame 12 also includes a bottom member 136 and a first outer side member 138 and a second outer side member 140, respectively. Bottom member 136 is supported by a series of pads 144 located underneath. First frame 12 also includes a first plexiglass shield 146 and a second plexiglass shield 147 that help to keep lint and other particulate matter from escaping.

The textile fabric web 20 upon exiting the walkway 142, as stated previously, first comes in contact with the sixth idler roll 36. The sixth idler roll 36 is fixedly attached to the inside of a first inner vertical frame member 214. As previously described, the textile fabric web 20 then comes in contact with the third treatment tube 56, the second engagement roll 60, and the fourth treatment tube 58.

There is a second inner vertical member 216 having the third air tube 72 and the fourth air tube 76 attached thereto. Slightly below the third air tube 72 is a third vacuum manifold 222 and in symmetrical manner, there is a fourth vacuum manifold 220 mounted slightly above the fourth air tube 76 along the second inner vertical number 216. After treatment, the textile fabric web 20 passes over the second lint/debris removal roll 40, as previously described, and then around the third drive roll 38.

The third drive roll 38 is rotated by means of a third drive motor 224 having a fifth pulley 226 attached thereto. The fifth pulley 226 rotates a sixth pulley 228 by means of third belt 232 that encircles the fifth pulley 226 and the sixth pulley 228. This sixth pulley 228 is attached to the third drive roll 38 by means of a third planetary gearbox 230. The third drive motor 224 is attached to the top member 202 of the second frame 14. The third planetary gearbox 230 is rotatably attached to the first inner vertical number 214 of second frame 14. An illustrative, but non-limiting, example of a third drive motor 224 would be a thirty (30) horsepower, six hundred (600) volt drive motor manufactured by Baldor located at Fort Smith, Ark. An illustrative, but non-limiting example, of a planetary gearbox 230 is manufactured by Andantex located at Ocean Township, N.J.

The textile fabric web 20 then passes over an eighth idler roll 42 that is attached below drive roll 38 and on the same side of the first inner vertical member 214 of second frame 14. The textile fabric web 20 then passes around a ninth idler roller 44 that is attached to the opposite side the first inner vertical number 214 of second frame 14. The textile fabric web 20 then exits the second frame 14.

The second frame 14 also includes a bottom member 236 and a first outer side member 238 and a second outer side member 240, respectively. Bottom member 236 is supported by a series of pads 244 located underneath. Second frame 14 also includes a plexiglass shield 246 and a fourth plexiglass shield 247 that help to keep lint and other particulate matter from escaping. There is a fourth vacuum manifold 248 mounted below the fourth plexiglass shield 247.

Figure 3:
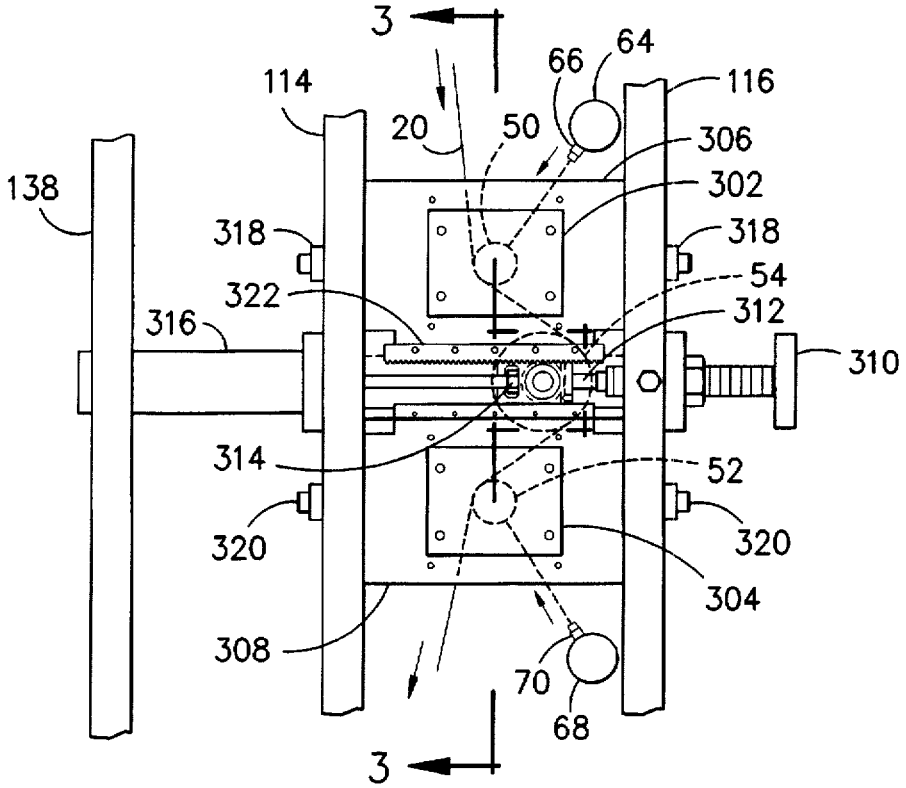
FIG. 3 is an isolated side view of two treatment rolls with an engagement roll located in between as shown in FIG. 2, with the textile fabric web being engaged by the two treatment rolls.
Figure 4:
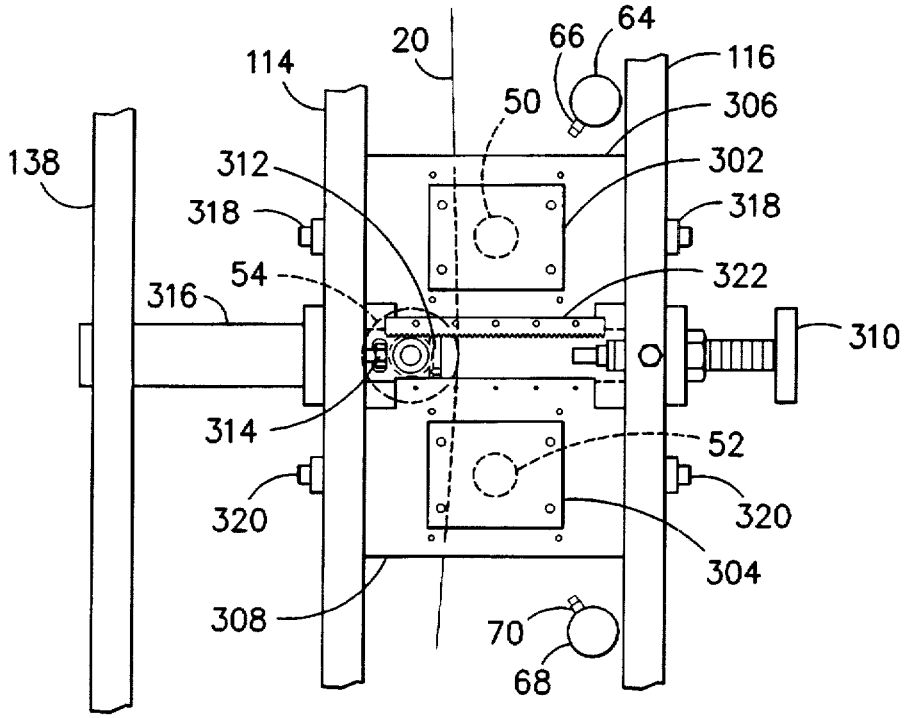
FIG. 4 is similar to FIG. 3 with the exception that the engagement roll is retracted and the dual treatment rolls do not come in contact with the moving textile fabric web.

Referring now to FIGS. 3 and 4, there is a pair of upper treatment roll mounts 302 that retain first treatment tube 50 in a fixed position in relation to the textile fabric web 20 and a pair of lower treatment tube mounts 304 that retain second treatment tube 52 a fixed position in relation to the textile fabric web 20. Upper treatment roll mount 302 is attached to an upper support plate 306 and interconnects the first inner vertical member 114 and the second inner vertical member 116. Lower treatment roll mount 304 is attached to lower support plate 308 that interconnects between the second inner vertical member 116 and the first inner vertical member 114. There is adjustment screw 310 that sets the engaged position of roll 54. Adjustment screw 310 has an inner threshold plunger 312 and operates as a stop for the first engagement roll 54. There is an air cylinder 316 having a shaft with a shaft end 314 that can move between the first inner vertical member 114 and first outer side member 138. This is for positioning the first engagement roll 54. FIG. 3 depicts an air cylinder 316 having a shaft end 314 that is in a fully extended position while FIG. 4 is with the air cylinder 316 having the shaft end 314 in the fully retracted position. There is a first series of connecting bolts and dual nuts 318 to attach upper support plate 306 to the first inner vertical member 114 and the second inner vertical member 116. There is also a second series of connecting bolts and dual nuts 320 to connect lower support plate 308 to the second inner vertical member 316 and the first inner vertical member 314. There is a rack and pinion mechanism 322 for making sure the engagement roll 54 is perpendicular to the first frame 12. This entire assembly is merely replicated for the second engagement roll 60 and is, therefore, not shown.

Figure 5:
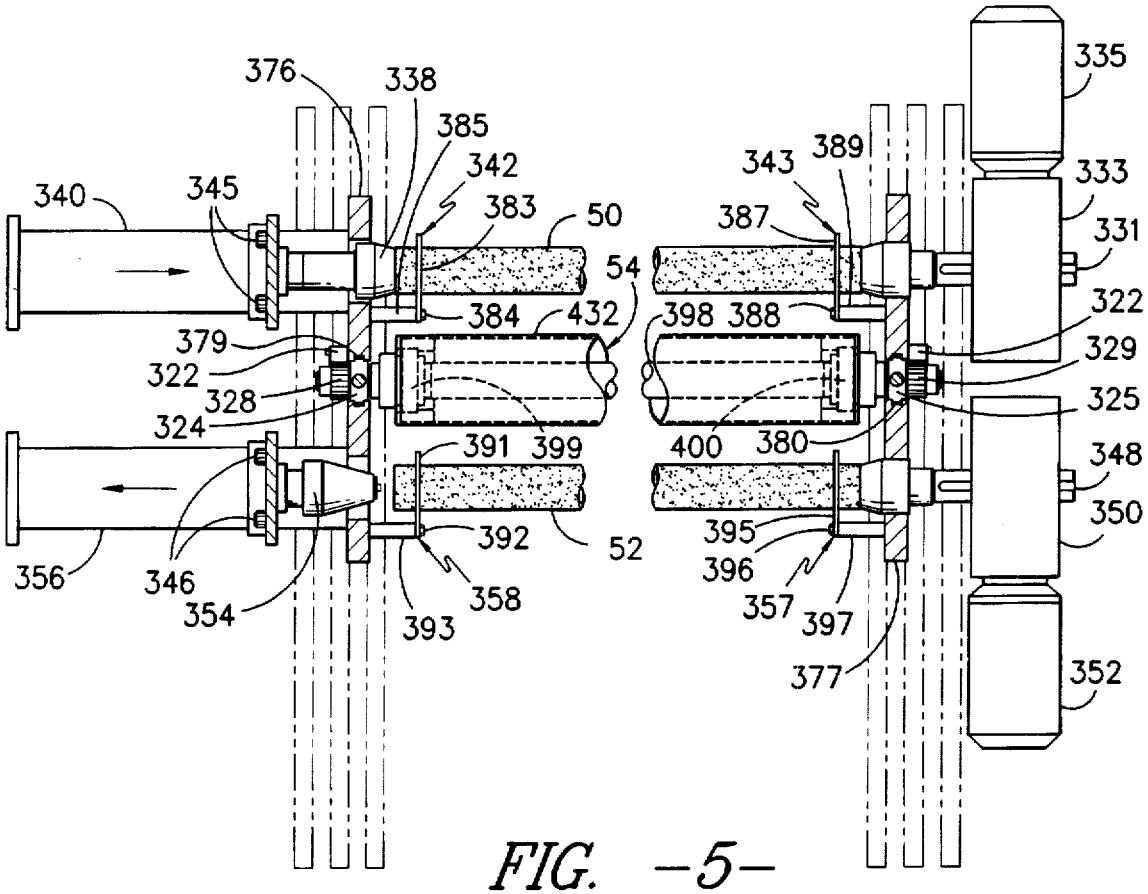
FIG. 5 is a cross-sectional view taken along Line 3—3 of FIG. 3.
Figure 6:
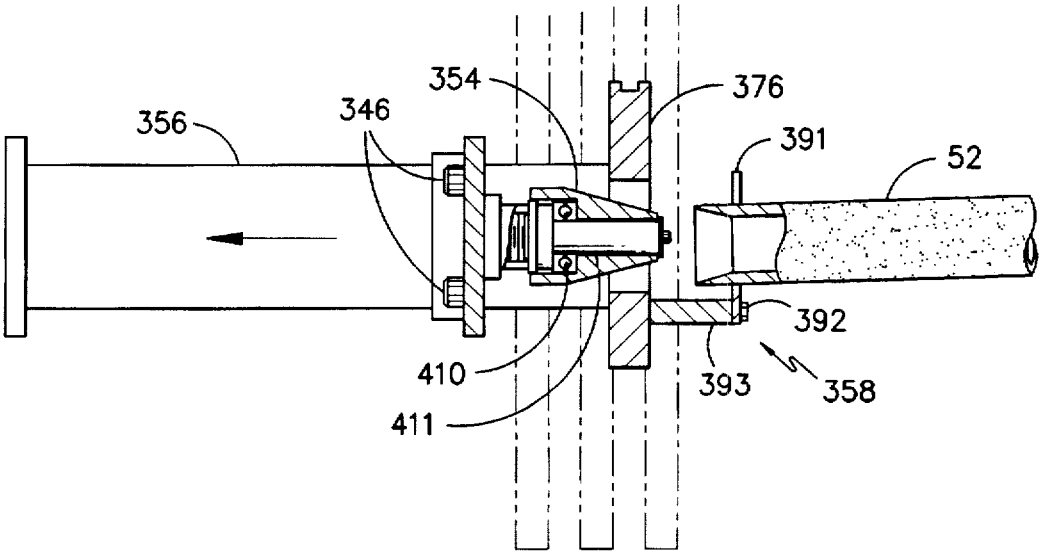
FIG. 6 is an isolated view of a conical idler clamp, as shown in FIG. 5, that is disengaged from a treatment roll.

Referring now to FIGS. 5 and 6, engagement roll 54 has a pair of slide bearings 324 and 325, respectively, that are attached to each end of engagement roll 54. The engagement roll 54 includes an engagement roll central shaft 398 and an engagement roll shell 432. Also, there is a pair of gears 328 and 329, respectively, at each end of engagement roll central shaft 398 for engagement with the rack 322. Bearing 324 is slidably mounted within a first support member 376 having first u-shaped channel 379. Bearing 325 is slidably mounted within a second support member 377 having a second u-shaped channel 380. The first support member 376 and the second support member 377 are attached to the first frame 12. The engagement roll central shaft 398 is rotatably mounted in bearings 324 and 325. The engagement roll shell 432 is rotatably attached to the engagement roll central shaft 398 by means of bearings 399 and 400. First treatment tube 50 is attached at one end to an axle 331 that is driven by a gearbox 333 that is powered by a first drive motor 335. Second treatment tube 52 is attached at one end to an axle 348 that is driven by a gearbox 350 that is powered by a second drive motor 352. The first axle 331 and the second axle 350 are all rotatably mounted within the apertures within the second support member 377. An illustrative, but non-limiting, example of a first drive motor 335 or second drive motor 352 would be a three (3) horsepower, six hundred (600) volt drive motor manufactured by Baldor located at Fort Smith, Ark. An illustrative, but non-limiting, example of a gearbox 333 or gearbox 350 is manufactured by Hub City located at Aberdeen, S.D. Both axle 331 or axle 348 rotate at a speed of between zero (0) to one hundred (100) revolutions per minute (r.p.m.). However, a preferred range of speeds for the axles 331 or 348 is between five (5) and one hundred (100) revolutions per minute (r.p.m.) and the optimal range is between ten (10) and forty (40) revolutions per minute (r.p.m.).

The other end of first treatment tube 50 is attached to a first conical idler clamp 338 by means of a first pair of attachment bolts 345. This first conical idler clamp 338 is retractable by means of a first air cylinder 340. The first conical idler clamp 338 can extend through an aperture in the first support member 376. The other end of second treatment tube 52 is attached to a second conical idler clamp 354 by means of a second pair of attachment bolts 346. The second conical idler clamp 354 is retractable by means of a second air cylinder 356. The second conical idler clamp 354 can extend through an aperture in the first support member 376.

There is a first pair of treatment tube support brackets generally indicated by numerals 342 and 343 to hold the first treatment tube 50 upright and in position when disengaged from the first conical idler clamp 338. Treatment tube support bracket 342 includes a first lateral support member 383 that is perpendicular to and attached to a first longitudinal member 385 by means of a first bolt 384 extending through both an aperture in the first lateral support member 383 and then through the longitudinal axis of the first longitudinal member 385 and then into the first support member 376. Treatment tube support bracket 343 includes a second lateral support member 387 that is perpendicular to and attached to a second longitudinal member 389 by means of a second bolt 388 extending through both an aperture in the second lateral support member 387 and then through the longitudinal axis of the second longitudinal member 389 and then into the first support member 376. Treatment tube support bracket 358 includes a third lateral support member 391 that is perpendicular to and attached to a third longitudinal member 393 by means of a third bolt 392 extending through both an aperture in the third lateral support member 391 and then through the longitudinal axis of the third longitudinal member 393 and then into the first support member 376. Treatment tube support bracket 357 includes a fourth lateral support member 395 that is perpendicular to and attached to a fourth longitudinal member 397 by means of a fourth bolt 396 extending through both an aperture in the fourth lateral support member 395 and then through the longitudinal axis of the fourth longitudinal member 397 and then into the second support member 377.

The first conical idler clamp 338 is attached to the end of the shaft of first air cylinder 340. The second conical idler clamp 354 is attached to the end of the shaft second air cylinder 356. An illustrative, but nonlimiting example of an air cylinder 340, 356 includes a four (4) inch diameter bore cylinder manufactured by Atlas Cylinder Corporation located at Eugene, Oreg. As shown in FIG. 6, the second conical idler clamp 354 utilizes thrust bearings 410 and bushings 411.

The treatment tube 50, 52, 56, and 58, are made to be disposable items with minimal machining. In this manner, worn material from the surface of these tubes does not have to be removed for reworking. In addition, tubes 50, 52, 56, and 58 do not have journals. In addition, treatment tubes 50, 52, 56, and 58 are rotated very slowly to allow the release of lint. Surface speeds of these tubes may be ten (10) percent or less of the textile fabric web 20. Therefore, the treatment is insensitive to the speed of the textile fabric web 20. If the speed of treatment tubes 50, 52, 56, and 58 are fixed as percentage of the speed of the textile fabric web 20, and said tubes are rotated in the same direction as the web, the process is completely insensitive to speed. This presents a marked contrast to sanding or sueding operations where the level of treatment is totally dependent on the fabric speed. In the instant invention, the surface speed of the abrasive roll is much less than that of the linear speed of the fabric web, as compared to most sanding or sueding processes, wherein the surface speed of the abrasive rolls far exceeds that of the fabric web. In the case of the sanding and sueding processes, fibers are cut and re-cut by high speed contact with the abrasive particles attached to the roll. This has the effect of removing very fine lint, which is easily lofted into the air by the windage created by the high speed of the abrasive roll, and which is difficult therefore to collect. A second effect is the grinding away of the surface of the fabric, with concomitant reductions of thickness, weight, and tensile strength of the fabric web. In contrast, in the case of this invention, the slow surface speed of the abrasive roll compared to the higher speed of the fabric web causes lint particles to entangle and roll up into larger particles in the time it takes for a point on the slowly rotating abrasive roll to rotate in and out of contact with the fabric. These larger particles are easier to collect as they are not readily lofted into the air. Also, fibers previously cut by the rounded and slow moving abrasive particles shields the fabric from the action of subsequently encountered rounded abrasive particles. The cutting process is therefore self-limiting as fibers are not repeatedly cut and the fabric surface is not substantially ground away. As relatively little fiber is removed, the color or the fabric is little changed, as the core fibers of the yarn, which may be more lightly colored due to ring dyeing effects, are not exposed. Also, much less noise is produced by the slowly rotating rolls compared to the high speed sander or suede rolls. Furthermore, since the speed of the treatment tube 50, 52, 56, and 58 is much less than the speed of the textile fabric web 20, strings and other debris do not wind about the treatment tubes 50, 52, 56, and 58. This textile treatment is especially effective when performed prior to a process that loosens the fabric since the cutting of the wrapper fibers of spun yarns accelerates the loosening process. In the case of polyester spun fabric, this effect is maximized when there is a calendaring step either before or after this process when the fabric has not yet been heat-set. Calendaring technology is disclosed in U.S. Pat. No. 5,404,626 that issued on Apr. 11, 1995, which is incorporated by reference as fully set forth herein.

The process of this invention can be further enhanced by treating the textile fabric web 20, under low tension, by low pressure, high velocity streams of gaseous fluid. This technology fully disclosed in U.S. Pat. No. 4,918,795 that issued on Apr. 24, 1990, which is incorporated by reference as fully set forth herein.

It is not intended that the scope of the invention be limited to the specific embodiment illustrated and described, rather, it is intended that the scope of the invention be defined by the appended claims and their equivalents.

What is claimed:

1. An apparatus for loosening and cutting wrapper fibers of spun yarns in a moving textile fabric web comprising:

(a) a frame:

(b) a roll, rotatably mounted on said frame, having a diameter of between one (1) to four (4) inches, wherein said roll is coated with abrasive particles and wherein said textile fabric web approaches said roll at an angle ranging between zero (0) to one hundred twenty degrees (120) with average contact pressure between said textile fabric web and said roll being at least two (2) pounds per square inch (p.s.i.);

(c) a mechanism for supplying said textile fabric web under tension to said roll;

(d) a mechanism for rotating said roll; and (e) a mechanism for removing said textile fabric web, after treatment, from said roll.

2. An apparatus for loosening and cutting wrapper fibers of spun yarns in a moving textile fabric web as defined in claim 1, wherein said mechanism for supplying said textile fabric web under tension to said roll includes a load cell.

3. An apparatus for loosening and cutting wrapper fibers of spun yarns in a moving textile fabric web as defined in claim 1, wherein said abrasive particles include metallic carbide particles.

4. An apparatus for loosening and cutting wrapper fibers of spun yarns in a moving textile fabric web as defined in claim 3, wherein said metallic carbide particles include tungsten carbide particles.

5. An apparatus for loosening and cutting wrapper fibers of spun yarns in a moving textile fabric web as defined in claim 3, wherein said metallic carbide particles are substantially lacking in facets.

6. An apparatus for loosening and cutting wrapper fibers of spun yarns in a moving textile fabric web as defined in claim 4, wherein said tungsten carbide particles are sprayed onto said roll by thermal spraying.

7. An apparatus for loosening and cutting wrapper fibers of spun yarns in a moving textile fabric web as defined in claim 1, further comprising a mechanism for removing lint and debris from said textile fabric web after treatment by said roll that includes at least one vacuum manifold.

8. An apparatus for loosening and cutting wrapper fibers of spun yarns in a moving textile fabric web as defined in claim 1, wherein said roll has a first end portion and a second end portion, and said mechanism for rotating said roll includes a first idler clamp attached to said first end of said roll and said first idler clamp is selectively attachable to an air cylinder and the second end portion of said roll is attached to an axle that is rotated by a gearbox that is connected to a drive motor.

9. An apparatus for loosening and cutting wrapper fibers of spun yarns in a moving textile fabric web as defined in claim 1, further comprising a calender for applying pressure of at least two hundred pounds per square inch either prior to or after treatment.

10. An apparatus for loosening and cutting wrapper fibers of spun yarns in a moving textile fabric web as defined in claim 1, further comprising a mechanism for projecting a plurality of low pressure, high velocity streams of gaseous fluid against only one side of said textile fabric web in a direction opposite and substantially tangential to a longitudinal axis of said textile fabric web causing vibrations in the textile fabric web to create saw-toothed waves therein having small bending radii which travel down the textile fabric web to increase the drape and flexibility thereof.

11. An apparatus for loosening and cutting wrapper fibers of spun yarns in a moving textile fabric web comprising:

(a) a frame:

(b) a roll, rotatably mounted on said frame, having a diameter of between one (1) to four (4) inches, wherein said roll is coated with abrasive particles and wherein said textile fabric web approaches said roll at an angle ranging between ten (10) to ninety degrees (90) with average contact pressure between said textile fabric web and said roll being at least two (2) pounds per square inch (p.s.i.);

(c) a mechanism for supplying said textile fabric web under tension to said roll;

(d) a mechanism for rotating said roll; and (e) a mechanism for removing said textile fabric web, after treatment, from said roll.

12. An apparatus for loosening and cutting wrapper fibers of spun yarns in a moving textile fabric web comprising:

(a) a frame:

(b) a roll, rotatably mounted on said frame, having a diameter of between one (1) to four (4) inches, wherein said roll is coated with abrasive particles and wherein said textile fabric web approaches said roll at an angle ranging between thirty (30) to eighty degrees (80) with average contact pressure between said textile fabric web and said roll being at least two (2) pounds per square inch (p.s.i.);

(c) a mechanism for supplying said textile fabric web under tension to said roll;

(d) a mechanism for rotating said roll; and (e) a mechanism for removing said textile fabric web, after treatment, from said roll.

13. An apparatus for loosening and cutting wrapper fibers of spun yarns in a moving textile fabric web comprising:

(a) a frame:

(b) a roll, rotatably mounted on said frame at a surface speed of between one (1) to ten (10) percent of fabric web speed, having a diameter of between one (1) to four (4) inches, wherein said roll is coated with abrasive particles and wherein said textile fabric web approaches said roll at an angle ranging between zero (0) to one hundred twenty (120) degrees with average contact pressure between said textile fabric web and said roll being at least two (2) pounds per square inch (p.s.i.);

(c) a mechanism for supplying said textile fabric web under tension to said roll;

(d) a mechanism for rotating said roll; and (e) a mechanism for removing said textile fabric web, after treatment, from said roll.

14. An apparatus for loosening and cutting wrapper fibers of spun yarns in a moving textile fabric web comprising:

(a) a frame:

(b) a roll, rotatably mounted on said frame at a surface speed of between one (1) to ten (10) percent of fabric web speed, having a diameter of between one (1) to four (4) inches, wherein said roll is coated with abrasive particles and wherein said textile fabric web approaches said roll at an angle ranging between ten (10) to ninety (90) degrees with average contact pressure between said textile fabric web and said roll being at least two (2) pounds per square inch (p.s.i.);

(c) a mechanism for supplying said textile fabric web under tension to said roll;

(d) a mechanism for rotating said roll; and (e) a mechanism for removing said textile fabric web, after treatment, from said roll.

15. An apparatus for loosening and cutting wrapper fibers of spun yarns in a moving textile fabric web comprising:

(a) a frame:

(b) a roll, rotatably mounted on said frame at a surface speed of between one (1) to ten (10) percent of fabric web speed, having a diameter of between one (1) to four (4) inches, wherein said roll is coated with abrasive particles and wherein said textile fabric web approaches said roll at an angle ranging between thirty (30) to eighty (80) degrees with average contact pressure between said textile fabric web and said roll being at least two (2) pounds per square inch (p.s.i.);

(c) a mechanism for supplying said textile fabric web under tension to said roll;

(d) a mechanism for rotating said roll; and (e) a mechanism for removing said textile fabric web, after treatment, from said roll.

16. An apparatus for loosening and cutting wrapper fibers of spun yarns in a moving textile fabric web comprising:

(a) a frame:

(b) a roll, rotatably mounted on said frame at a surface speed of between one (1) to ten (10) percent of fabric web speed, having a diameter of between one and one half (1.5) to three and one half (3.5) inches, wherein said roll is coated with abrasive particles and wherein said textile fabric web approaches said roll at an angle ranging between zero (0) to one hundred twenty (120) degrees with average contact pressure between said textile fabric web and said roll being at least two (2) pounds per square inch (p.s.i.);

(c) a mechanism for supplying said textile fabric web under tension to said roll;

(d) a mechanism for rotating said roll; and (e) a mechanism for removing said textile fabric web, after treatment, from said roll.

17. An apparatus for loosening and cutting wrapper fibers of spun yarns in a moving textile fabric web comprising:

(a) a frame:

(b) a roll, rotatably mounted on said frame at a surface speed of between one (1) to ten (10) percent of fabric web speed, having a diameter of between two (2) to three (3) inches, wherein said roll is coated with abrasive particles and wherein said textile fabric web approaches said roll at an angle ranging between zero (0) to one hundred twenty (120) degrees with average contact pressure between said textile fabric web and said roll being at least two (2) pounds per square inch;

(c) a mechanism for supplying said textile fabric web under tension to said roll;

(d) a mechanism for rotating said roll; and (e) a mechanism for removing said textile fabric web, after treatment, from said roll.

18. An apparatus for loosening and cutting wrapper fibers of spun yarns in a moving textile fabric web comprising:

(a) a frame:

(b) a first roll, rotatably mounted on said frame at a speed of between one (1) to two hundred (200) revolutions per minute, having a diameter of between one (1) to four (4) inches, wherein said first roll is coated with abrasive particles and wherein said textile fabric web approaches said first roll at an angle ranging between zero to one hundred and twenty degrees with average contact pressure between said textile fabric web and said first roll being at least two pounds per square inch;

(c) a mechanism for supplying said textile fabric web under tension to said first roll;

(d) a mechanism for rotating said first roll;

(e) a second roll, rotatably mounted on said frame at a speed of between one (1) to two hundred (200) revolutions per minute, having a diameter of between one (1) to four (4) inches, wherein said second roll is coated with abrasive particles and wherein said textile fabric web approaches said second roll at an angle ranging between zero to one hundred and twenty degrees with average contact pressure between said textile fabric web and said second roll being at least two pounds per square inch;

(f) a mechanism for moving said textile fabric web between said first roll and said second roll which includes a rotatable treatment roll that can move between a first position and a second position;

(g) a mechanism for rotating said second roll; and (h) a mechanism for removing said textile fabric web under tension from said second roll.

19. An apparatus for loosening and cutting wrapper fibers of spun yarns in a moving textile fabric web as defined in claim 18, wherein said mechanism for supplying said textile fabric web under tension to said first roll includes a load cell.

20. An apparatus for loosening and cutting wrapper fibers of spun yarns in a moving textile fabric web as defined in claim 19, wherein said abrasive particles include metallic carbide particles.

21. An apparatus for loosening and cutting wrapper fibers of spun yarns in a moving textile fabric web as defined in claim 20, wherein said metallic carbide particles include tungsten carbide particles.

22. An apparatus for loosening and cutting wrapper fibers of spun yarns in a moving textile fabric web as defined in claim 20, wherein said metal carbide particles are substantially lacking in facets.

23. An apparatus for loosening and cutting wrapper fibers of spun yarns in a moving textile fabric web as defined in claim 21, wherein said tungsten carbide particles are sprayed onto said roll by thermal spraying.

24. An apparatus for loosening and cutting wrapper fibers of spun yarns in a moving textile fabric web as defined in claim 18, further comprising a mechanism for removing lint and debris from said textile fabric web after treatment by said first roll and said second roll that includes at least one air tube, having a plurality of jets, that direct high pressure air against said textile fabric web in a range of twenty (20) to one hundred and fifty (150) pounds per square inch.

25. An apparatus for loosening and cutting wrapper fibers of spun yarns in a moving textile fabric web as defined in claim 18, further comprising a mechanism for removing lint and debris from said textile fabric web after treatment by said first roll that includes a rotatable roll, having a plurality of longitudinal grooves.

26. An apparatus for loosening and cutting wrapper fibers of spun yarns in a moving textile fabric web as defined in claim 18, further comprising a mechanism for removing lint and debris from said textile fabric web after treatment by said first roll that includes a rotatable roll, having a diameter of between three (3) and sixteen (16) inches and having a plurality of longitudinal grooves, that is rotatable between five hundred (500) to three thousand (3,000) revolutions per minute wherein said groves are spaced apart in a range of between 0.05 and two (2) inches and having a depth of between 0.01 to five (5) inches.

27. An apparatus for loosening and cutting wrapper fibers of spun yarns in a moving textile fabric web as defined in claim 18, further comprising a mechanism for removing lint and debris from said textile fabric web after treatment by said first roll and said second roll that includes at least one vacuum manifold.

28. An apparatus for loosening and cutting wrapper fibers of spun yarns in a moving textile fabric web as defined in claim 18, wherein said first roll has a first end portion and a second end portion, and said mechanism for rotating said first roll includes a first idler clamp attached to said first end portion of said first roll and said first idler clamp is selectively attachable to a first air cylinder and the second end portion of said first roll is attached to a second idler clamp attached to a first axle that is rotated by a first gearbox that is connected to a first drive motor and wherein said second roll has a first end portion and a second end portion, and said mechanism for rotating said second roll includes a third idler clamp attached to said first end portion of said second roll and said third idler clamp is selectively attachable to a second air cylinder and the second end portion of said second roll is attached to a fourth idler clamp that is connected to a second axle that is rotated by a second gearbox that is connected to a second drive motor.

29. An apparatus for loosening and cutting wrapper fibers of spun yarns in a moving textile fabric web as defined in claim 18, further comprising a calender for applying pressure of at least two hundred pounds per linear inch of said web width either prior to or after treatment.

30. An apparatus for loosening and cutting wrapper fibers of spun yarns in a moving textile fabric web comprising:

(a) a frame:

(b) a first roll, rotatably mounted on said frame at a speed of between one (1) to two hundred (200) revolutions per minute, having a diameter of between one and one half (1.5) to three and one half (3.5) inches, wherein said first roll is coated with abrasive particles and wherein said textile fabric web approaches said first roll at an angle ranging between zero to one hundred and twenty degrees with average contact pressure between said textile fabric web and said first roll being at least two pounds per square inch;

(c) a mechanism for supplying said textile fabric web under tension to said first roll;

(d) a mechanism for rotating said first roll;

(e) a second roll, rotatably mounted on said frame at a speed of between one (1) to two hundred (200) revolutions per minute, having a diameter of between one and one half (1.5) to three and one half (3.5) inches, wherein said second roll is coated with abrasive particles and wherein said textile fabric web approaches said second roll at an angle ranging between zero to one hundred and twenty degrees with average contact pressure between said textile fabric web and said second roll being at least two pounds per square inch;

(f) a mechanism for moving said textile fabric web between said first roll and said second roll which includes a rotatable treatment roll that can move between a first position and a second position;

(g) a mechanism for rotating said second roll;

(h) a mechanism for removing lint and debris from said textile fabric web; and (i) a mechanism for removing said textile fabric web under tension from said second roll.

31. An apparatus for loosening and cutting wrapper fibers of spun yarns in a moving textile fabric web comprising:

(a) a frame:

(b) a first roll, rotatably mounted on said frame at a surface speed of between one (1) to two hundred (200) revolutions per minute, having a diameter of between one (1) to four (4) inches, wherein said first roll is coated with abrasive particles and wherein said textile fabric web approaches said first roll at an angle ranging between zero to one hundred and twenty degrees with average contact pressure between said textile fabric web and said first roll being at least two pounds per square inch;

(c) a mechanism for supplying said textile fabric web under tension to said first roll;

(d) a mechanism for rotating said first roll;

(e) a second roll, rotatably mounted on said frame at a speed of between one (1) to two hundred (200) revolutions per minute, having a diameter of between one (1) to four (4) inches, wherein said second roll is coated with abrasive particles and wherein said textile fabric web approaches said second roll at an angle ranging between zero to one hundred and twenty degrees with average contact pressure between said textile fabric web and said second roll being at least two pounds per square inch;

(f) a mechanism for moving said textile fabric web between said first roll and said second roll which includes a rotatable treatment roll that can move between a first position and a second position;

(g) a mechanism for rotating said second roll; and (h) a mechanism for removing said textile fabric web under tension from said second roll.

32. An apparatus for loosening and cutting wrapper fibers of spun yarns in a moving textile fabric web, having a top portion and a bottom portion, comprising:

(a) a frame:

(b) a first roll, rotatably mounted on said frame at a surface speed of between one (1) to two hundred (200) revolutions per minute, having a diameter of between one (1) to four (4) inches, wherein said first roll is coated with abrasive particles and wherein said top portion of said textile fabric web approaches said first roll at an angle ranging between zero to one hundred and twenty degrees with average contact pressure between said textile fabric web and said first roll being at least two pounds per square inch;

(c) a mechanism for supplying said textile fabric web under tension to said first roll;

(d) a mechanism for rotating said first roll;

(e) a second roll, rotatably mounted on said frame at a speed of between one (1) to two hundred (200) revolutions per minute, having a diameter of between one (1) to four (4) inches, wherein said second roll is coated with abrasive particles and wherein said top portion of said textile fabric web approaches said second roll at an angle ranging between zero to one hundred and twenty degrees with average contact pressure between said textile fabric web and said second roll being at least two pounds per square inch;

(f) a mechanism for moving said textile fabric web between said first roll and said second roll which includes a first rotatable treatment roll that can move between a first position and a second position;

(g) a mechanism for rotating said second roll;

(h) a third roll, rotatably mounted on said frame at a speed of between one (1) to two hundred (200) revolutions per minute, having a diameter of between one (1) to four (4) inches, wherein said third roll is coated with abrasive particles and wherein said bottom portion of said textile fabric web approaches said third roll at an angle ranging between zero to one hundred and twenty degrees with average contact pressure between said textile fabric web and said third roll being at least two pounds per square inch;

(i) a mechanism for supplying said textile fabric web under tension to said third roll;

(j) a mechanism for rotating said third roll;

(k) a fourth roll, rotatably mounted on said frame at a speed of between one (1) to two hundred (200) revolutions per minute, having a diameter of between one (1) to four (4) inches, wherein said fourth roll is coated with abrasive particles and wherein said bottom portion of said textile fabric web approaches said fourth roll at an angle ranging between zero to one hundred and twenty degrees with average contact pressure between said textile fabric web and said fourth roll being at least two pounds per square inch;

(l) a mechanism for moving said textile fabric web between said third roll and said fourth roll which includes a second rotatable treatment roll that can move between a first position and a second position;

(m) a mechanism for rotating said fourth roll; and (n) a mechanism for removing said textile fabric web under tension from said fourth roll.

33. An apparatus for loosening and cutting wrapper fibers of spun yarns in a moving textile fabric web as defined in claim 32, wherein said mechanism for supplying said textile fabric web under tension to said first roll includes a load cell.

34. An apparatus for loosening and cutting wrapper fibers of spun yarns in a moving textile fabric web as defined in claim 33, wherein said abrasive particles include metallic carbide particles.

35. An apparatus for loosening and cutting wrapper fibers of spun yarns in a moving textile fabric web as defined in claim 34, wherein said metallic carbide particles include tungsten carbide particles.

36. An apparatus for loosening and cutting wrapper fibers of spun yarns in a moving textile fabric web as defined in claim 34, wherein said metallic carbide particles are substantially lacking in facets.

37. An apparatus for loosening and cutting wrapper fibers of spun yarns in a moving textile fabric web as defined in claim 35, wherein said tungsten carbide particles are sprayed onto said roll by thermal spraying.

38. An apparatus for loosening and cutting wrapper fibers of spun yarns in a moving textile fabric web as defined in claim 32, further comprising a first mechanism for removing lint and debris from said textile fabric web after treatment by said first roll and said second roll that includes at least one first air tube, having a plurality of jets, that direct high pressure air against said textile fabric web in a range of forty (40) to one hundred (100) pounds per square inch and further comprising a second mechanism for removing lint and debris from said textile fabric web after treatment by said third roll and said fourth roll that includes at least one second air tube, having a plurality of jets, that direct high pressure air against said textile fabric web in a range of forty (40) to one hundred (100) pounds per square inch.

39. An apparatus for loosening and cutting wrapper fibers of spun yarns in a moving textile fabric web as defined in claim 32, further comprising a mechanism for removing lint and debris from said textile fabric web after treatment by said first roll that includes a rotatable roll, having a plurality of longitudinal grooves.

40. An apparatus for loosening and cutting wrapper fibers of spun yarns in a moving textile fabric web as defined in claim 32, further comprising a mechanism for removing lint and debris from said textile fabric web after treatment by said first roll that includes a rotatable roll, having a diameter of between three and one half (3.5) and twelve (12) inches and having a plurality of longitudinal grooves, that is rotatable between eight hundred (800) to two thousand and five hundred (2,500) revolutions per minute wherein said groves are spaced apart in a range of between 0.1 and one (1) inches and having a depth of between 0.01 to 0.25 inches.

41. An apparatus for loosening and cutting wrapper fibers of spun yarns in a moving textile fabric web as defined in claim 32, further comprising a first mechanism for removing lint and debris from said textile fabric web after treatment by said first roll and said second roll that includes at least one first vacuum manifold and further comprising a second mechanism for removing lint and debris from said textile fabric web after treatment by said third roll and said fourth roll that includes at least one second vacuum manifold.

42. An apparatus for loosening and cutting wrapper fibers of spun yarns in a moving textile fabric web as defined in claim 32, wherein said first roll has a first end portion and a second end portion, and said mechanism for rotating said first roll includes a first idler clamp attached to said first end portion of said first roll and said first idler clamp is selectively attachable to a first air cylinder and the second end portion of said first roll is attached to a second idler clamp attached to a first axle that is rotated by a first gearbox that is connected to a first drive motor and wherein said second roll has a first end portion and a second end portion, and said mechanism for rotating said second roll includes a third idler clamp attached to said first end portion of said second roll and said third idler clamp is selectively attachable to a second air cylinder and the second end portion of said second roll is attached to a fourth idler clamp that is connected to a second axle that is rotated by a second gearbox that is connected to a second drive motor and wherein said third roll has a first end portion and a second end portion, and said mechanism for rotating said third roll includes a fifth idler clamp attached to said first end portion of said third roll and said fifth idler clamp is selectively attachable to a third air cylinder and the second end portion of said third roll is attached to a sixth idler clamp attached to a third axle that is rotated by a third gearbox that is connected to a third drive motor and wherein said fourth roll has a first end portion and a second end portion, and said mechanism for rotating said fourth roll includes a seventh idler clamp attached to said first end portion of said fourth roll and said seventh idler clamp is selectively attachable to a fourth air cylinder and the second end portion of said fourth roll is attached to an eighth idler clamp that is connected to a fourth axle that is rotated by a fourth gearbox that is connected to a fourth drive motor.

43. An apparatus for loosening and cutting wrapper fibers of spun yarns in a moving textile fabric web as defined in claim 32, further comprising a calender for applying pressure of two hundred pounds per square inch either prior or after treatment.

44. An apparatus for loosening and cutting wrapper fibers of spun yarns in a moving textile fabric web, having a top portion and a bottom portion, comprising:

(a) a frame:

(b) a first roll, rotatably mounted on said frame at a surface speed of between one (1) to two hundred (200) revolutions per minute, having a diameter of between one and one half (1.5) to three and one half (3.5) inches, wherein said first roll is coated with abrasive particles and wherein said top portion of said textile fabric web approaches said first roll at an angle ranging between zero to one hundred and twenty degrees with average contact pressure between said textile fabric web and said first roll being at least two pounds per square inch;

(c) a mechanism for supplying said textile fabric web under tension to said first roll;

(d) a mechanism for rotating said first roll;

(e) a second roll, rotatably mounted on said frame at a speed of between one (1) to two hundred (200) revolutions per minute, having a diameter of between one and one half (1.5) to three and one half (3.5), wherein said second roll is coated with abrasive particles and wherein said top portion of said textile fabric web approaches said second roll at an angle ranging between zero to one hundred and twenty degrees with average contact pressure between said textile fabric web and said second roll being at least two pounds per square inch;

(f) a mechanism for moving said textile fabric web between said first roll and said second roll which includes a first rotatable treatment roll that can move between a first position and a second position;

(g) a mechanism for rotating said second roll;

(h) a third roll, rotatably mounted on said frame at a speed of between one (1) to two hundred (200) revolutions per minute, having a diameter of between one and one half (1.5) to three and one half (3.5), wherein said third roll is coated with abrasive particles and wherein said bottom portion of said textile fabric web approaches said third roll at an angle ranging between zero to one hundred and twenty degrees with average contact pressure between said textile fabric web and said third roll being at least two pounds per square inch;

(i) a mechanism for supplying said textile fabric web under tension to said third roll;

(j) a mechanism for rotating said third roll;

(k) a fourth roll, rotatably mounted on said frame at a speed of between one (1) to two hundred (200) revolutions per minute, having a diameter of between one and one half (1.5) to three and one half (3.5) inches, wherein said fourth roll is coated with abrasive particles and wherein said bottom portion of said textile fabric web approaches said fourth roll at an angle ranging between zero to one hundred and twenty degrees with average contact pressure between said textile fabric web and said fourth roll being at least two pounds per square inch;

(l) a mechanism for moving said textile fabric web between said third roll and said fourth roll which includes a second rotatable treatment roll that can move between a first position and a second position;

(m) a mechanism for rotating said fourth roll; and (n) a mechanism for removing said textile fabric web under tension from said fourth roll.

45. An apparatus for loosening and cutting wrapper fibers of spun yarns in a moving textile fabric web, having a top portion and a bottom, comprising:

(a) a frame:

(b) a first roll, rotatably mounted on said frame at a surface speed of between one (1) to two hundred (200) revolutions per minute, having a diameter of between two (2) to three (3) inches, wherein said first roll is coated with abrasive particles and wherein said top portion of said textile fabric web approaches said first roll at an angle ranging between zero to one hundred and twenty degrees with average contact pressure between said textile fabric web and said first roll being at least two pounds per square inch;

(c) a mechanism for supplying said textile fabric web under tension to said first roll;

(d) a mechanism for rotating said first roll;

(e) a second roll, rotatably mounted on said frame at a speed of between one (1) to two hundred (200) revolutions per minute, having a diameter of between two (2) to three (3) inches, wherein said second roll is coated with abrasive particles and wherein said top portion of said textile fabric web approaches said second roll at an angle ranging between zero to one hundred and twenty degrees with average contact pressure between said textile fabric web and said second roll being at least two pounds per square inch;

(f) a mechanism for moving said textile fabric web between said first roll and said second roll which includes a first rotatable treatment roll that can move between a first position and a second position;

(g) a mechanism for rotating said second roll;

(h) a third roll, rotatably mounted on said frame at a speed of between one (1) to two hundred (200) revolutions per minute, having a diameter of between two (2) to three (3) inches, wherein said third roll is coated with abrasive particles and wherein said bottom portion of said textile fabric web approaches said third roll at an angle ranging between zero to one hundred and twenty degrees with average contact pressure between said textile fabric web and said third roll being at least two pounds per square inch;

(i) a mechanism for supplying said textile fabric web under tension to said third roll;

(j) a mechanism for rotating said third roll;

(k) a fourth roll, rotatably mounted on said frame at a speed of between one (1) to two hundred (200) revolutions per minute, having a diameter of between two (2) to three (3) inches, wherein said fourth roll is coated with abrasive particles and wherein said bottom portion of said textile fabric web approaches said fourth roll at an angle ranging between zero to one hundred and twenty degrees with average contact pressure between said textile fabric web and said fourth roll being at least two pounds per square inch;

(l) a mechanism for moving said textile fabric web between said third roll and said fourth roll which includes a second rotatable treatment roll that can move between a first position and a second position;

(m) a mechanism for rotating said fourth roll; and (n) a mechanism for removing said textile fabric web under tension from said fourth roll.

46. An apparatus for loosening and cutting wrapper fibers of spun yarns in a moving textile fabric web comprising:

(a) a frame:

(b) a roll, rotatably mounted on said frame, having a diameter of between one (1) to four (4) inches, wherein said roll is coated with abrasive particles and wherein said textile fabric web approaches said roll at an angle ranging between zero (0) to one hundred twenty (120) degrees with average contact pressure between said textile fabric web and said roll being at least two (2) pounds per square inch (p.s.i.);

(c) a mechanism for supplying said textile fabric web under tension to said roll;

(d) a mechanism for rotating said roll;

(e) a mechanism for removing lint and debris from said textile fabric web after treatment by said roll; and (f) a mechanism for removing said textile fabric web, after treatment, from said roll.

47. An apparatus for loosening and cutting wrapper fibers of spun yarns in a moving textile fabric web as defined in claim 46, wherein said mechanism for removing lint and debris from said textile fabric web after treatment by said roll includes at least one air tube, having a plurality of jets, that direct high pressure air against said textile fabric web in a range of five (5) to two hundred and fifty (250) pounds per square inch.

48. An apparatus for loosening and cutting wrapper fibers of spun yarns in a moving textile fabric web as defined in claim 46, wherein said mechanism for removing lint and debris from said textile fabric web after treatment by said roll includes a rotatable roll, having a plurality of longitudinal grooves.

49. An apparatus for loosening and cutting wrapper fibers of spun yarns in a moving textile fabric web as defined in claim 46, wherein said mechanism for removing lint and debris from said textile fabric web after treatment by said roll includes a rotatable roll, having a diameter of between three (3) and twelve (12) inches and having a plurality of longitudinal grooves, that is rotatable between five hundred (500) to two thousand four hundred (2400) revolutions per minute (r.p.m.) wherein said groves are spaced apart in a range of between one (1) and twenty (20) degrees and having a depth of at least 0.01 inches.

50. A process for loosening and cutting wrapper fibers of spun yarns in a moving textile fabric web comprising:

(a) supplying said textile fabric web under tension to a roll having a diameter of between one (1) to four (4) inches, wherein said roll is coated with abrasive particles and wherein said textile fabric web approaches said roll at an angle ranging between zero to one hundred and twenty degrees with average contact pressure between said textile fabric web and said roll being at least two pounds per square inch; and (b) rotating said roll at a speed of between one (1) to two hundred (200) revolutions per minute.

51. A textile fabric having a surface treated in accordance with the process of claim 50.

52. A process for loosening and cutting wrapper fibers of spun yarns in a moving textile fabric web comprising:

(a) supplying said textile fabric web under tension to a roll having a diameter of between one and one half (1.5) to three and one half (3.5) inches, wherein said roll is coated with abrasive particles and wherein said textile fabric web approaches said roll at an angle ranging between zero to one hundred and twenty degrees with average contact pressure between said textile fabric web and said roll being at least two pounds per square inch; and (b) rotating said roll at a speed of between one (1) to two hundred (200) revolutions per minute.

53. A process for loosening and cutting wrapper fibers of spun yarns in a moving textile fabric web comprising:

a) supplying said textile fabric web under tension to a first roll having a diameter of between one (1) to four (4) inches, wherein said first roll is coated with abrasive particles and wherein said textile fabric web approaches said first roll at an angle ranging between zero to one hundred and twenty degrees with average contact pressure between said textile fabric web and said first roll being at least two pounds per square inch;

(b) rotating said first roll at a speed of between one (1) to two hundred (200) revolutions per minute;

(c) supplying said textile fabric web under tension to a second roll having a diameter of between one (1) to four (4) inches, wherein said second roll is coated with abrasive particles and wherein said textile fabric web approaches said second roll at an angle ranging between zero to one hundred and twenty degrees with average contact pressure between said textile fabric web and said second roll being at least two pounds per square inch; and (d) rotating said second roll at a speed of between one (1) to two hundred (200) revolutions per minute.

54. A textile fabric having a surface treated in accordance with the process of claim 53.

55. A process for loosening and cutting wrapper fibers of spun yarns in a moving textile fabric web comprising:

(a) supplying said textile fabric web under tension to a first roll having a diameter of between one and one half (1.5) to three and one half (3.5) inches, wherein said first roll is coated with abrasive particles and wherein said textile fabric web approaches said first roll at an angle ranging between zero to one hundred and twenty degrees with average contact pressure between said textile fabric web and said first roll being at least two pounds per square inch;

(b) rotating said first roll at a speed of between one (1) to two hundred (200) revolutions per minute;

(c) supplying said textile fabric web under tension to a second roll having a diameter of between one and one half (1.5) to three and one half (3.5) inches, wherein said second roll is coated with abrasive particles and wherein said textile fabric web approaches said second roll at an angle ranging between zero to one hundred and twenty degrees with average contact pressure between said textile fabric web and said second roll being at least two pounds per square inch; and (d) rotating said second roll at a speed of between one (1) to two hundred (200) revolutions per minute.

56. A process for loosening and cutting wrapper fibers of spun yarns in a moving textile fabric web, having a top portion and a bottom portion, comprising:

(a) supplying said textile fabric web under tension to a first roll having a diameter of between one (1) to four (4) inches, wherein said first roll is coated with abrasive particles and wherein said top portion of said textile fabric web approaches said first roll at an angle ranging between zero to one hundred and twenty degrees with average contact pressure between said textile fabric web and said first roll being at least two pounds per square inch;

(b) rotating said first roll at a speed of between one (1) to two hundred (200) revolutions per minute;

(c) supplying said textile fabric web under tension to a second roll having a diameter of between one (1) to four inches, wherein said second roll is coated with abrasive particles and wherein said top portion of said textile fabric web approaches said second roll at an angle ranging between zero to one hundred and twenty degrees with average contact pressure between said textile fabric web and said second roll being at least two pounds per square inch; and (d) rotating said second roll at a speed of between one (1) to two hundred (200) revolutions per minute;

(e) supplying said textile fabric web under tension to a third roll having a diameter of between one (1) to four (4) inches, wherein said third roll is coated with abrasive particles and wherein said bottom portion of said textile fabric web approaches said third roll at an angle ranging between zero to one hundred and twenty degrees with average contact pressure between said textile fabric web and said third roll being at least two pounds per square inch;

(f) rotating said third roll at a speed of between one (1) to two hundred (200) revolutions per minute;

(g) supplying said textile fabric web under tension to a fourth roll having a diameter of between one (1) to four (4) inches, wherein said fourth roll is coated with abrasive particles and wherein said bottom portion of said textile fabric web approaches said fourth roll at an angle ranging between zero to one hundred and twenty degrees with average contact pressure between said textile fabric web and said fourth roll being at least two pounds per square inch; and (h) rotating said fourth roll at a speed of between one (1) to two hundred (200) revolutions per minute.

57. A textile fabric having a surface treated in accordance with the process of claim 56.

58. A process for loosening and cutting wrapper fibers of spun yarns in a moving textile fabric web, having a top portion and a bottom portion, comprising:

(a) supplying said textile fabric web under tension to a first roll having a diameter of between one and one half (1.5) to three and one half (3.5) inches, wherein said first roll is coated with abrasive particles and wherein said top portion of said textile fabric web approaches said first roll at an angle ranging between zero to one hundred and twenty degrees with average contact pressure between said textile fabric web and said first roll being at least two pounds per square inch;

(b) rotating said first roll at a speed of between one (1) to two hundred (200) revolutions per minute;

(c) supplying said textile fabric web under tension to a second roll having a diameter of between one and one half (1.5) to three and one half (3.5) inches, wherein said second roll is coated with abrasive particles and wherein said top portion of said textile fabric web approaches said second roll at an angle ranging between zero to one hundred and twenty degrees with average contact pressure between said textile fabric web and said second roll being at least two pounds per square inch; and (d) rotating said second roll at a speed of between one (1) to two hundred (200) revolutions per minute;

(e) supplying said textile fabric web under tension to a third roll having a diameter of between one and one half (1.5) to three and one half (3.5) inches, wherein said third roll is coated with abrasive particles and wherein said bottom portion of said textile fabric web approaches said third roll at an angle ranging between zero to one hundred and twenty degrees with average contact pressure between said textile fabric web and said third roll being at least two pounds per square inch;

(f) rotating said third roll at a speed of between one (1) to two hundred (200) revolutions per minute;

(g) supplying said textile fabric web under tension to a fourth roll having a diameter of between one and one half (1.5) to three and one half (3.5) inches, wherein said fourth roll is coated with abrasive particles and wherein said bottom portion of said textile fabric web approaches said fourth roll at an angle ranging between zero to one hundred and twenty degrees with average contact pressure between said textile fabric web and said fourth roll being at least two pounds per square inch; and (h) rotating said fourth roll at a speed of between one (1) to two hundred revolutions per minute.

59. A process for loosening and cutting wrapper fibers of spun yarns in a moving textile fabric web comprising:

(a) supplying said textile fabric web under tension to a roll having a diameter of between one (1) to four (4) inches, wherein said roll is coated with abrasive particles and wherein said textile fabric web approaches said roll at an angle ranging between zero to one hundred and twenty degrees with average contact pressure between said textile fabric web and said roll being at least two pounds per square inch;

(b) rotating said roll at a speed of between one (1) to two hundred (200) revolutions per minute; and (c) displacing lint and debris from said textile fabric web with a plurality of gas jets and a rotating roll with a plurality of longitudinal grooves.

60. A process for loosening and cutting wrapper fibers of spun yarns in a moving textile fabric web comprising:

(a) supplying said textile fabric web under tension to a first roll having a diameter of between one (1) to four (4) inches, wherein said first roll is coated with abrasive particles and wherein said textile fabric web approaches said first roll at an angle ranging between zero to one hundred and twenty degrees with average contact pressure between said textile fabric web and said first roll being at least two pounds per square inch;

(b) rotating said first roll at a speed of between one (1) to two hundred (200) revolutions per minute;

(c) supplying said textile fabric web under tension to a second roll having a diameter of between one (1) to four (4) inches, wherein said second roll is coated with abrasive particles and wherein said textile fabric web approaches said second roll at an angle ranging between zero to one hundred and twenty degrees with average contact pressure between said textile fabric web and said second roll being at least two pounds per square inch;

(d) rotating said second roll at a speed of between one (1) to two hundred (200) revolutions per minute; and (e) displacing lint and debris from said textile fabric web with a plurality of gas jets and at least one rotating roll with a plurality of longitudinal grooves.

61. A process for loosening and cutting wrapper fibers of spun yarns in a moving textile fabric web, having a top portion and a bottom portion, comprising:

(a) supplying said textile fabric web under tension to a first roll having a diameter of between one (1) to four (4) inches, wherein said first roll is coated with abrasive particles and wherein said top portion of said textile fabric web approaches said first roll at an angle ranging between zero to one hundred and twenty degrees with average contact pressure between said textile fabric web and said first roll being at least two pounds per square inch;

(b) rotating said first roll at a speed of between one (1) to two hundred (200) revolutions per minute;

(c) supplying said textile fabric web under tension to a second roll having a diameter of between one (1) to four (4) inches, wherein said second roll is coated with abrasive particles and wherein said top portion of said textile fabric web approaches said second roll at an angle ranging between zero to one hundred and twenty degrees with average contact pressure between said textile fabric web and said second roll being at least two pounds per square inch; and (d) rotating said second roll at a speed of between one (1) to two hundred (200) revolutions per minute;

(e) supplying said textile fabric web under tension to a third roll having a diameter of between one (1) to four (4) inches, wherein said third roll is coated with abrasive particles and wherein said bottom portion of said textile fabric web approaches said third roll at an angle ranging between zero to one hundred and twenty degrees with average contact pressure between said textile fabric web and said third roll being at least two (2) pounds per square inch (p.s.i.);

(f) rotating said third roll at a speed of between one (1) to two hundred (200) revolutions per minute;

(g) supplying said textile fabric web under tension to a fourth roll having a diameter of between one (1) to four (4) inches, wherein said fourth roll is coated with abrasive particles and wherein said bottom portion of said textile fabric web approaches said fourth roll at an angle ranging between zero to one hundred and twenty degrees with average contact pressure between said textile fabric web and said fourth roll being at least two pounds per square inch;

(h) rotating said fourth roll at a speed of between one (1) to two hundred (200) revolutions per minute; and (i) displacing lint and debris from said textile fabric web with a plurality of gas jets and at least one rotating roll with a plurality of longitudinal grooves.

* * * * *